United States Patent [19]

Greve et al.

[11] 4,071,728

[45] Jan. 31, 1978

[54] CROSSPOINT SWITCH COMPRISING BISTABLE CROSSPOINTS

[75] Inventors: Reinhard Cornelis Greve, Baarn; Cornelis Pieter van Luijk, Hilversum, both of Netherlands

[73] Assignee: U.S. Philips Corporation, New York, N.Y.

[21] Appl. No.: 445,992

[22] Filed: Feb. 26, 1974

[30] Foreign Application Priority Data

Mar. 15, 1973 Netherlands ..... 7303599

[51] Int. Cl.[2] ..... H01H 63/33

[52] U.S. Cl. ..... 200/175; 335/112; 335/113

[58] Field of Search ..... 200/1 R, 175–178; 335/106, 107, 109, 111–113, 115, 116, 121, 122, 126

[56] References Cited

U.S. PATENT DOCUMENTS

| | | | |
|---|---|---|---|
| 2,647,166 | 7/1953 | Lens | 200/177 |
| 3,529,113 | 9/1970 | Vazquez et al. | 335/112 X |
| 3,614,330 | 10/1971 | Levallois-Perret et al. | 200/177 X |
| 3,838,239 | 9/1974 | Maruscak et al. | 200/175 |
| 3,863,044 | 1/1975 | McCormick | 335/112 X |

FOREIGN PATENT DOCUMENTS

| | | |
|---|---|---|
| 1,933,167 | 1/1971 | Germany. |

*Primary Examiner*—James R. Scott

*Attorney, Agent, or Firm*—Frank R. Trifari; David R. Treacy

[57] ABSTRACT

A crosspoint switch comprising a number of selection bars and switching bars which cross each other at right angles and have recesses and guides for catching members. A catching member is moved by a particular selection bar and switching bar to actuate an electrical contact through a member having two stable positions. The switching bars have a fork-like recess arranged to enable renewed actuation of bars previously actuated for switching on a crosspoint, without the switched-on crosspoint being switched off.

12 Claims, 14 Drawing Figures

CROSSPOINT SWITCH COMPRISING BISTABLE CROSSPOINTS

BACKGROUND OF THE INVENTION

1. Field of the invention

The invention relates to a crosspoint switch comprising a number of selection bars and switching bars which cross each other at right angles and which are provided in the vicinity of each crosspoint with a recess and a guide, respectively, which enable the movement of a catching member which is actuated by the relevant selection bar and the relevant switching bar and which is arranged near the relevant crosspoint, the catching member movement being successively parallel to the movement direction of the relevant selection bar and the movement direction of the relevant switching bar, each catching member actuating at least one electrical contact which is arranged near the relevant crosspoint by way of a coupling member which has two stable positions.

2. Description of the Prior Art

In a crosspoint switch of the kind set forth which is known from German Patent application No. 1,933,167, the catching member consists of a unilaterally clamped wire spring, the free end of which is moved into a deflected position from a neutral position by successive actuation of a selection bar and a switching bar, the deflected position corresponding to the switched-on position of the relevant crosspoint. After the return of successively the selection bar and the switching bar to their neutral position, the wire spring and hence the spring contact which is actuated by this spring by way of a coupling member is kept in the switched-on position because the wire spring bears under spring pressure against a side of the selection bar which has returned to the neutral position.

A drawback of the described crosspoint switch is that even though the switching bar which is used for switching on the crosspoint can be utilized for switching on a crosspoint other than the already switched-on crosspoint, the selection bar used for switching on the first crosspoint cannot be used for switching on the other crosspoint. Renewed operation of this selection bar would cause the wire spring which bears under spring pressure against a side thereof to disengage from this side and to return to its neutral position by snapping into a recess which is provided in this selection bar and which corresponds to the neutral position of the wire spring. The already switched on crosspoint would then be switched off.

SUMMARY OF THE INVENTION

The object of the invention is to provide a crosspoint switch in which the selection bar and switching bar used to switch on a first crosspoint can each be used for switching other crosspoints on without affecting the first crosspoint.

According to the invention selection bars are provided, near each cross-point, with a slot-like recess which extends transverse to the movement direction thereof and which forms a guide for the relevant catching member, the length of the recess being at least slightly greater than the stroke of the switching bars, the switching bars being provided, near each crosspoint, with a fork-like recess having at least first and second portions, the walls of which form a guide for the catching member and extend parallel to the movement direction of the selection bars. The catching member is engaged between the walls of the first recess portion when the associated switch is to be switched on or off, or when the switch is off and the selection bar is energized to set up another crosspoint. The second recess portion provides room for the catching member to move if the selection bar is excited while the associated switch is switched on and the switching bar is in the neutral position.

A special embodiment of a crosspoint switch according to the invention is characterized in that each catching member is slidable, parallel to the movement direction of the selection bars, in the said coupling member which itself is slidable parallel to the movement direction of the switching bars, thus actuating the contact associated with the relevant crosspoint.

A further preferred embodiment of a crosspoint switch according to the invention is characterized in that the coupling member is coupled to the actuation member by way of a pushing member having two stable positions.

BRIEF DESCRIPTION OF THE DRAWING

The invention will be described in detail hereinafter with reference to the drawing in which.

DESCRIPTION OF THE PREFERRED EMBODIMENT

Figure 1:
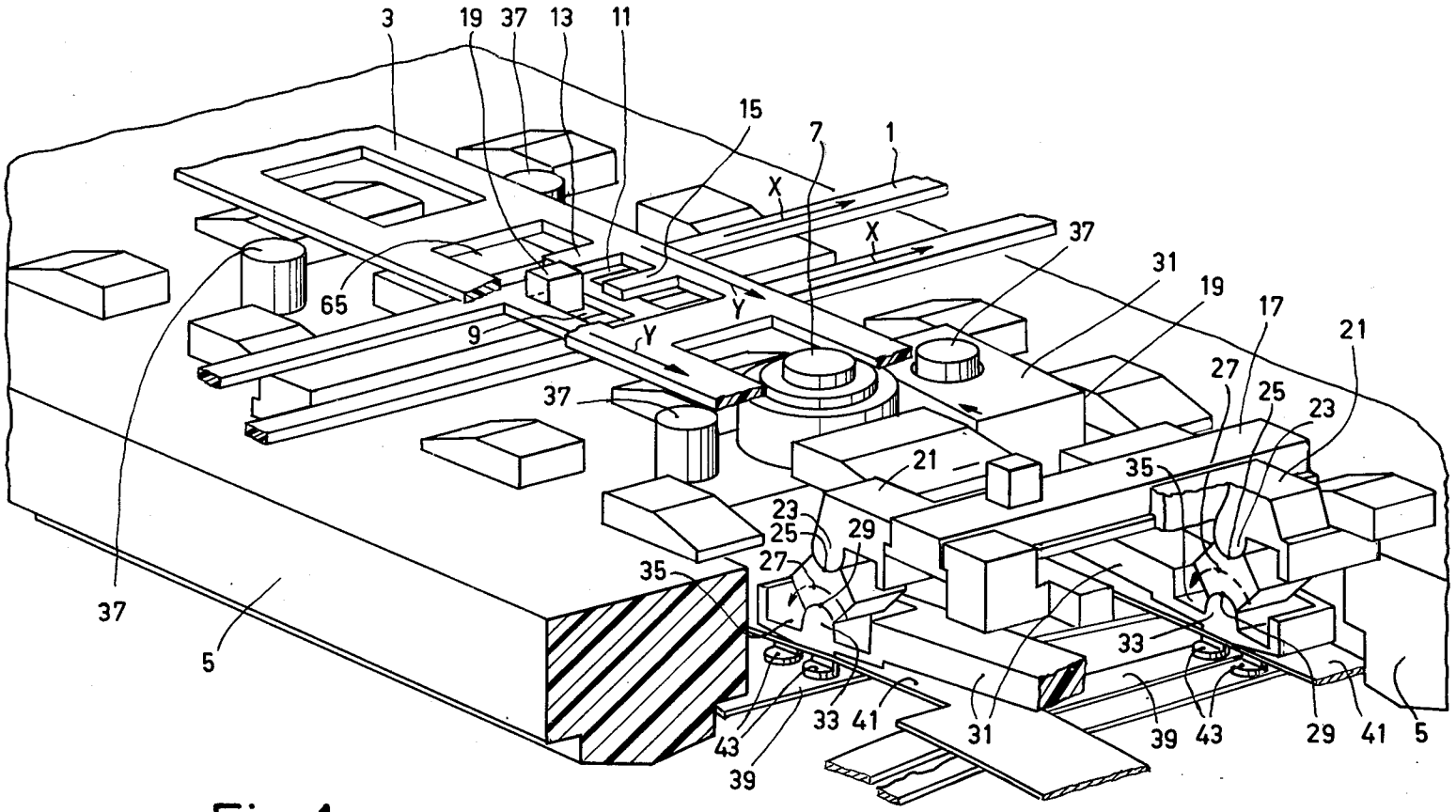
FIG. 1 is a partly broken away perspective plan view of a preferred embodiment of a portion of a cross-point switch according to the invention.

The crosspoint switch shown in FIG. 1 comprises a number of selection bars 1 and switching bars 3 which cross each other at right angles. For the sake of clarity, FIG. 1 shows only one selection bar 1 and one switching bar 3 with the associated crosspoint. Also for the sake of clarity, the selection bar 1 and the switching bar 3 are shown in a shifted position (in FIG. 1 to the left) with respect to the crosspoint associated therewith. The selection bar 1 and the switching bar 3 consist, for example, of strips of a synthetic material such as Mylar, in which recesses are formed. The excitation unit for the bars is of a known type, so it is not shown. The excitation unit may be, for example, of the electromagnetic, electrodynamic, pneumatic or hydraulic type.

It is assumed that the selection bars 1 extend in the x-direction and that the switching bars 3 extend in the y-direction. The movement direction of the bars for switching on a given crosspoint is referred to as the positive direction. The bars are guided by projections, such as the cylindrical projection 7, which are formed on a base 5 of the crosspoint switch. The stroke of the bars can be limited by abutments formed on the base 5. However, this limitation can alternatively be incorporated in the excitation unit of each bar. In an electromagnetic excitation unit this can be effected, for example, by way of an abutment for the armature present therein. An advantage of the latter possibility is that the bars can be comparatively light because no impact forces can occur therein.

The selection bar 1 is provided with a number of slot-like closed recesses 9 in the form of a rectangle, only one of which is shown in FIG. 1. The longest rectangle sides 8 and 10 of the recess 9, functioning as engaging and disengaging surfaces respectively, as hereinafter described, extend perpendicular to the movement direction of the selection bar.

The switching bar 3 is provided with a number of fork-like, closed recesses 11, the teeth 13 and 15 of which have walls 12 and 14, functioning as actuating and releasing surfaces respectively as hereinafter described, the teeth and walls extending in the movement direction of a selection bar 1. The fork-like recess 11 co-operates with a beamlike catching member 17 which is slidable in the x-direction as well as in the y-direction and which is provided with a cubical projection 19 which projects through the recesses 9 and 11. For the sake of clarity, the projection 19 of the catching member 17 is shown both at the area of the crosspoint (in FIG. 1 at the right) and in a position which is shifted with respect to the crosspoint (in FIG. 1 to the left). The catching member 17 is guided to be slidable in the x-direction in two coupling members 21, each of which is provided with a cylindrical, rounded portion 23. The coupling members 21 are guided to be slidable in the y-direction in the base 5. The rounded portions 23 of the coupling members 21 engage under some friction in a cylindrical recess 25 of a pushing member 27 which has a mainly cubical shape and which has two stable positions. In addition to the recess 25, the pushing member 27 is provided with a cylindrical recess 29 which is situated opposite to the recess 25 in and which is engaged under some friction a cylindrical rounded portion 33 which is formed on an actuation member 31. The two actuation members 31 corresponding to the coupling members 21 and the pushing members 27 are arranged to be mirror-symmetrical with respect to the catching member 17. On both sides of each rounded portion 29 a recess 35 is located, the shape of which corresponds to the shape of the pushing member 27. Even though in practice only the recess denoted by the reference 35 in FIG. 1 is required, each of the actuation members 31 is provided with two recesses in order to achieve uniformity in the manufacture of actuation members in spite of the mirror-symmetrical arrangement. The essentially beam-like actuation members 31 are constructed to be rigid in the embodiment shown in FIG. 1. The bars 1 and 3, the base 5, the pushing member 27 and the members 17, 19, 23 and 31 can be made, for example, of polycarbonate. In order to achieve the necessary vertical movability, the actuation members 31 are journalled with a given play about a cylindrical pin 37 which is formed on the base 5. The vertical movement is produced by tilting in a vertical plane about the pin 37. However, the actuation members 31 can alternatively be rigidly secured to the base 5 and, for example, the portion containing the recesses 35 can have a flexible construction.

During their vertical movement, the actuation members 31 cause contact between flexible metal contact reeds 39 and 41 which cross each other at right angles and which are secured in the base 5 of the crosspoint switch. At the area of each crosspoint, two pairs of contact reeds co-operate. The contact reeds are provided with contact material 43 so as to ensure reliable contact.

Figure 2:
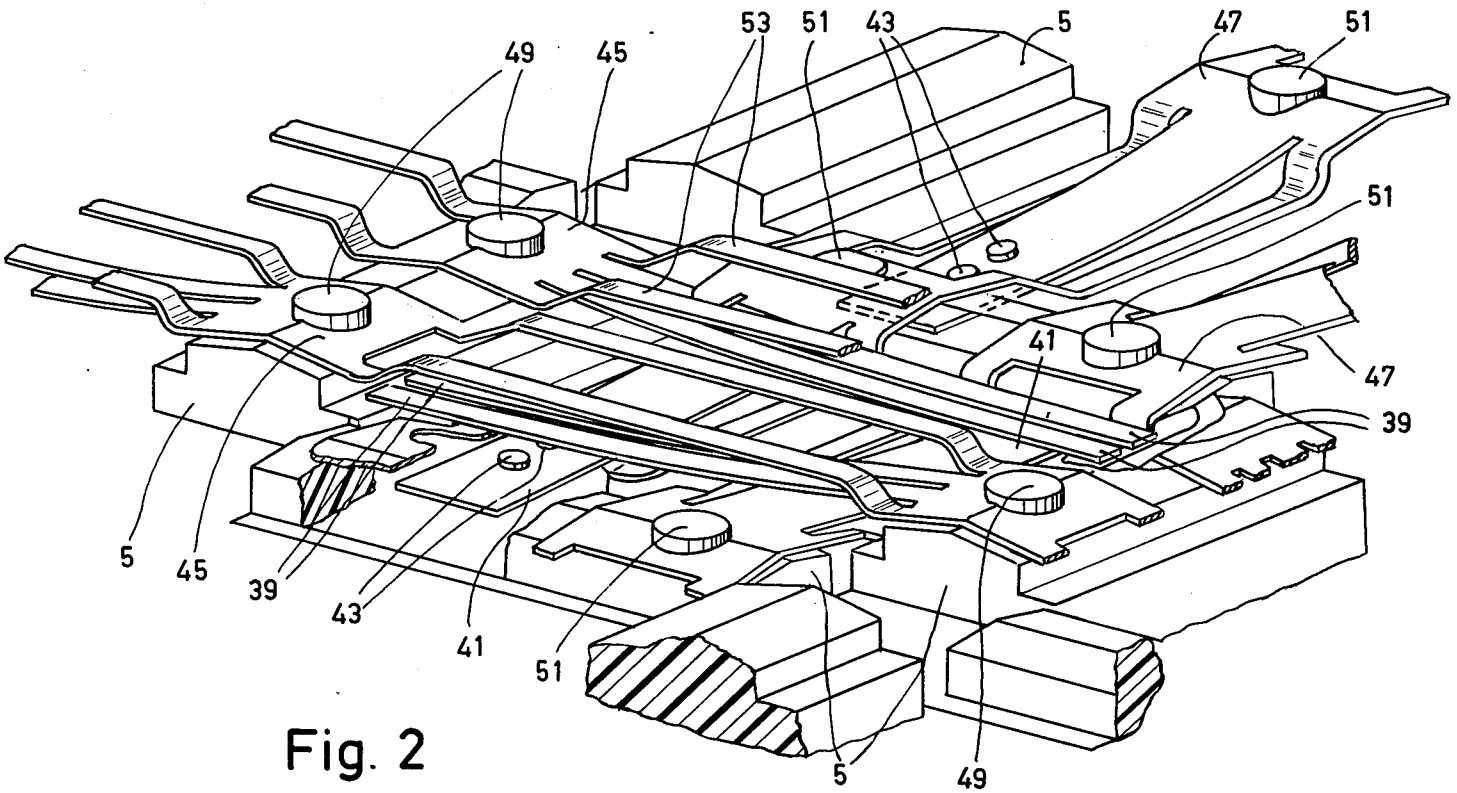
FIG. 2 is a partly broken away perspective bottom view of the crosspoint switch shown in FIG. 1.

The assembly of contact reeds will be described in detail with reference to the plan view of FIG. 1 which is given in FIG. 2. In FIG. 2 the same references are used as in FIG. 1. The contact reeds 39 and 41 consist of flexible tabs which are cut from the metal strips 45 and 47 at the area of the relevant crosspoints. The metal strips are secured to the base 5 by way of hot deformation of cylindrical pins 49 and 51 which project through openings in metal strips 45 and 47, respectively, and which form part of the base. In a complete crosspoint switch comprising many crosspoints there may be differences in the pitch distance of the holes in the metal strip and also in the pitch distance of the cylindrical pins on the base. However, the contact materials of strips which cross each are still arranged opposite to each other, because this contact material is provided at accurately the same distance from the relevant holes in the strips, the inaccuracies of the holes and pins being compensated for in the flexible edge portion of the strips such as, for example, the edge portions 53 of the strip 45.

Hereinafter, the operation of a crosspoing switch according to the invention will be described in detail, notably with reference to FIG. 3.

Figure 3A:
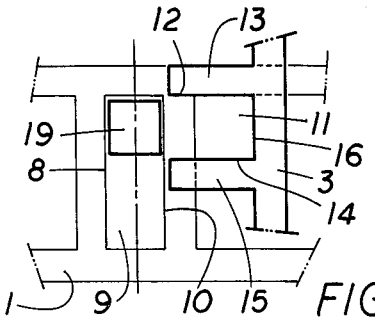
FIGS. 3A–3J are diagrammatic representations of the sequence of movements for the switching on and subsequent switching off of a crosspoint for the crosspoint switch shown in FIG. 1.
Figure 3F:
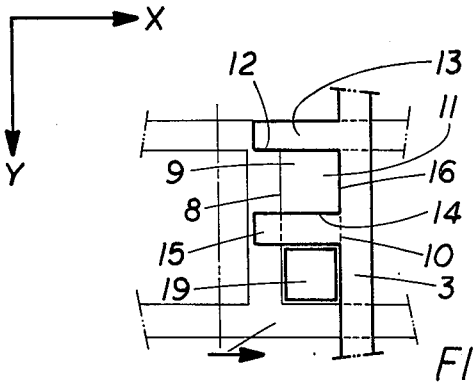
Figure 3B:
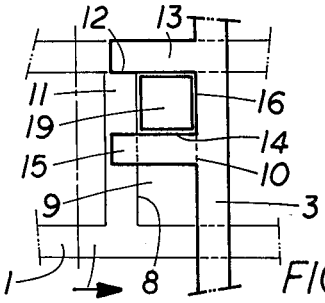
Figure 3G:
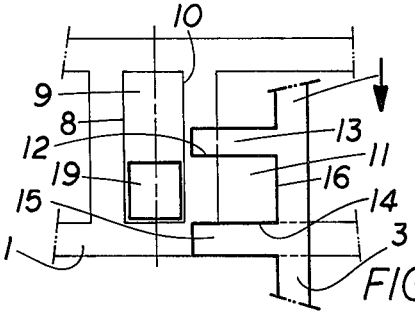
Figure 3C:
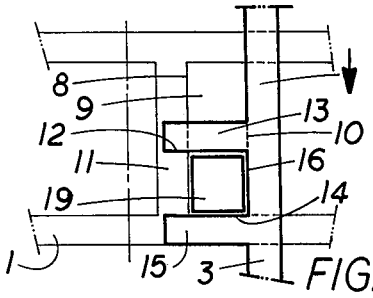

The position of selection bar 1, switching bar 3 and projection 19 of the catching member 17 shown in FIG 3A represents the neutral position of the crosspoint shown in FIGS. 1 and 2 the projection 19 being aligned opposite the portion of the recess 11 between the teeth 13 and 15. When the selection bar 1 is excited, the selection bar is moved in the positive x-direction to a selection position over a distance such that the projection 19 taken along by the engaging surface selection bar is completely situated in the portion of the recess 11 between the teeth 13 and 15 in the switching bar 3. In the present case the stroke of the selection bar 1 is proportioned such that the projection 19 just fails to contact the wall 16 of the switching bar 3 so as to avoid impact forces on the switching bar. While the excitation of the selection bar 1 is maintained (position of the catching member 17 and projection 19 in FIG. 3B), the switching bar 3 is also excited. As a result, the switching bar 3 then moves in the positive y-direction to a switching position over a distance which is slightly smaller than the length of long rectangle side 8 and 10 of the recess 9 in the selection bar 1. The projection 19 is engaged by the actuating wall 12 of tooth 13 of the fork-like recess 11, which wall moves along a switching path parallel to the y-direction, and is then displaced over the same distance and reaches the position shown in FIG. 3C. During the movement of the selection bar 1 and the projection 19 in the positive x-direction, the catching member 17, is guided in coupling members 21. The coupling members 21 remain in their neutral position. However, due to the movement of the projection 19 in the positive y-direction, the catching member 17 and the coupling members 21 which are guided in the base 5 are displaced over the same distance in the positive y-direction as the projection 19 itself, the coupling members thus being moved to a switched position. As a result, the pushing members 27 which remained in the recesses 35 (see FIG. 1) of the actuation members 31 in the neutral position of FIG. 3A and also in the position of FIG. 3B are now tilted to the position indicated in FIG. 1. The distance between the coupling members 21 and the rounded portions 33 of the actuation members 31 is increased due to the tilting of the actuation members 31 about the relevant cylindrical pins 37. The tilting actuation members 31 press the respective contact reeds 39 and 41 against each other, with the result that the crosspoint is switched on. Per crosspoint each time two contacts are thus made, one for each direction of speech. Because the position of the pushing members 27 shown in FIG. 1 is stable, the excitation of the selection bar 1 as well as of the switching bar 3 can be terminated. While the excitation of the switching bar 3 continues, first the excitation of the selection bar 1 is terminated. The selection bar 1 then returns to its neutral position, the disengaging surface 10 meanwhile taking along the projection 19 to the position shown in FIG. 3D, the projection 19 being aligned opposite the portion of the recess 11 between the teeth 13 and 15. The crosspoint remains switched on. The excitation of the switching bar 3 can be terminated only after position of FIG. 3D has been reached. The switching bar 3 then returns to its neutral position. The positions of selection bar 1, switching bar 3, and projection 19 with respect to each other are as shown in FIG. 3E, the projection 19 being aligned opposite a second portion of the recess 11 to the side of the tooth 15 opposite the disengaging surface 14. Consequently, the fact that the crosspoint remains switched on involves no energy consumption.

The crosspoint remaining switched on, the selection bar 1 as well as the switching bar 3 can now be used for switching on or switching off the further crosspoints of the crosspoint switch associated with these bars. FIG. 3F shows the result of excitation of the selection bar 1 as part of a switching-on or switching-off sequence of another crosspoint associated with that selection bar; the projection 19 has been moved into the second portion of the recess 11 to the side of the tooth 15 opposite the disengaging surface 14. FIG. 3G shows the result if, from the situation shown in FIG. 3E, the switching bar 3 is excited as part of a switching-on or switching-off sequence affecting another crosspoint, or as the first step in switching-off this switched-on crosspoint.

Figure 3H:
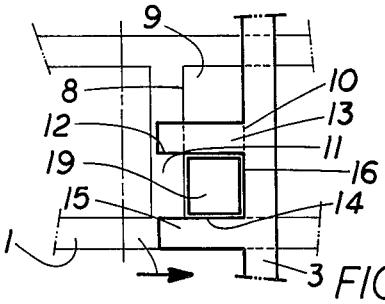
Figure 3D:
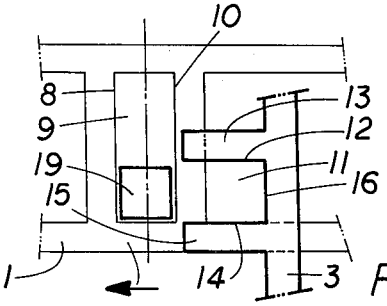
Figure 3I:
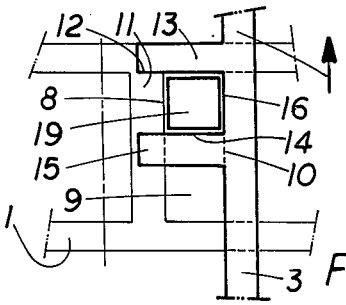
Figure 3E:
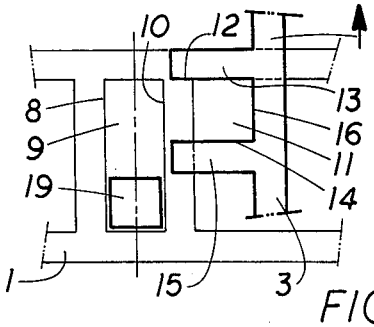
Figure 3J:
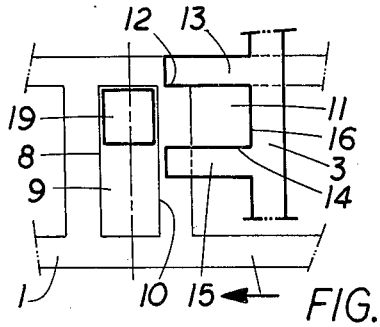

It will be obvious that the switched-on crosspoint is switched off by first exciting the switching bar 3 (as shown in FIG. 3G) and, the switching bar 3 being excited, by subsequently exciting the selection bar 1 (FIG. 3H). Subsequently, first the excitation of the switching bar 3 is terminated so that the releasing surface 14 engages the projection 19, moving the catching member 17 back to the neutral position (FIG. 3I) and after that the excitation of selection bar 1 is terminated (FIG. 3J).

Figure 4:
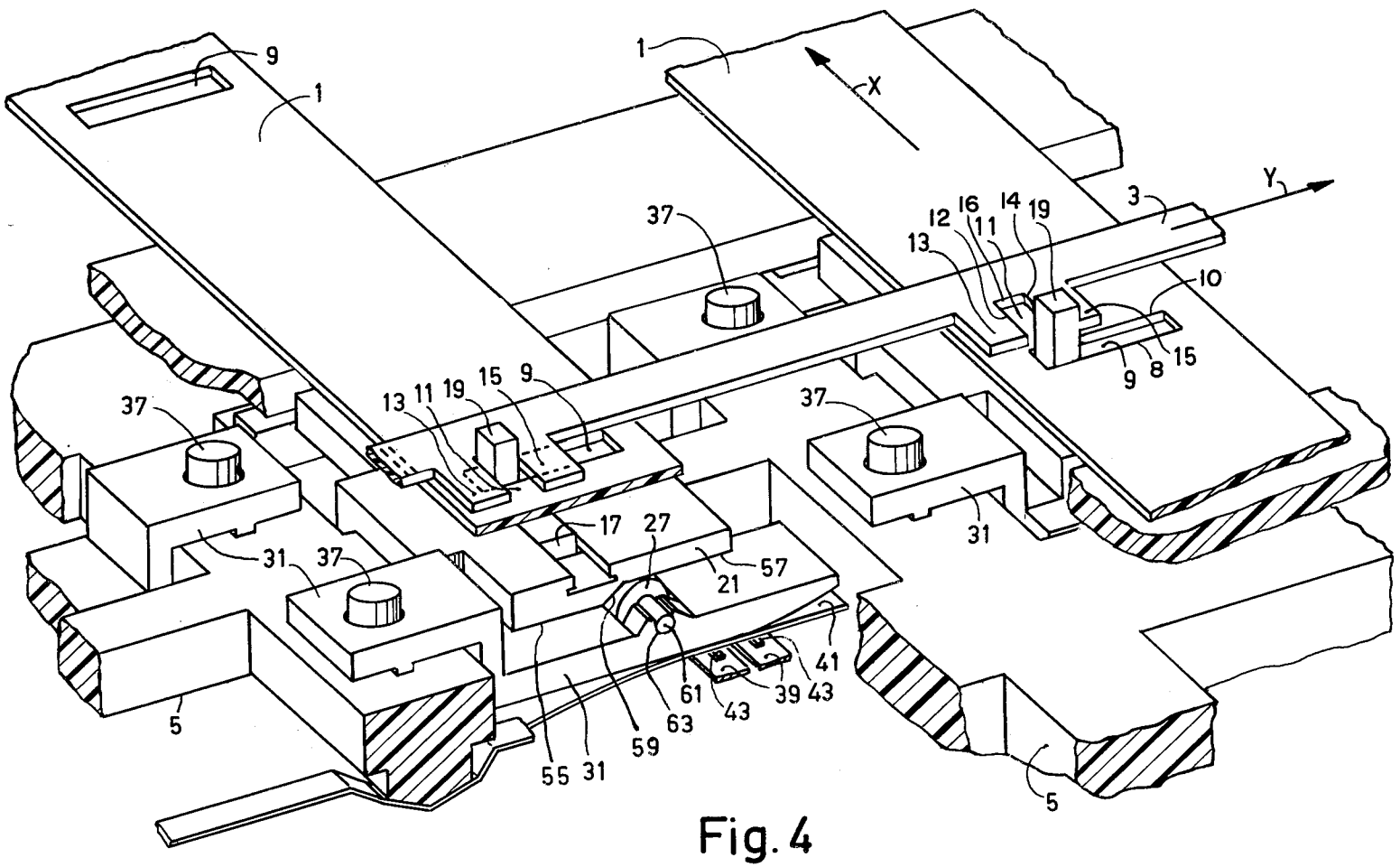
FIG. 4 is a broken away perspective plan view of a further preferred embodiment of a portion of a crosspoint switch according to the invention.

The further preferred embodiment of a crosspoint switch according to the invention which is shown in FIG. 4 is provided with reference numerals which correspond to FIG. 1 as much as possible. The difference between the two crosspoint switches is the shape of the coupling member 21, the pushing member 27 and the actuation member 31. The plate-like coupling member 21 of the embodiment shown in FIG. 4 comprises two surfaces 55 and 57 on its lower side which are situated at different levels and which adjoin a curved surface 59. The surfaces 55 and 57 form a cam surface on which the pushing member 27 bears, member 27 being in the form of a cylindrical roller whose shaft ends 61 are journalled to be rotatable in a cylindrical cavity 63 which is formed in the actuation member 31. The pushing member 27 shown in FIG. 4 offers an advantage over the pushing member 27 shown in FIG. 1 in that the friction occurring between pushing member and actuation member or coupling member, respectively, is smaller due to the rolling contact.

The coupling members 21, the pushing members 27 and the actuation members 31 need not necessarily have the shape shown in the FIGS. 1 and 4. In general, the requirement that the movement of the coupling member in the y-direction must cause a movement of the contact reeds need be satisfied. This can be realized in many ways. Any member having two stable positions such as, for example, a common two-position switch can even replace pushing member and actuation member. However, the embodiments shown in the FIGS. 1 and 4 have both the advantage that they result in a very compact construction and that they can be readily manufactured in bulk, for example, by injection molding.

The switching bar 3 need not necessarily have the shape shown in FIG. 1 either. The switching bar 3 shown in FIG. 4 — not closed — performs equally well as the closed version of FIG. 1.

Figure 5:
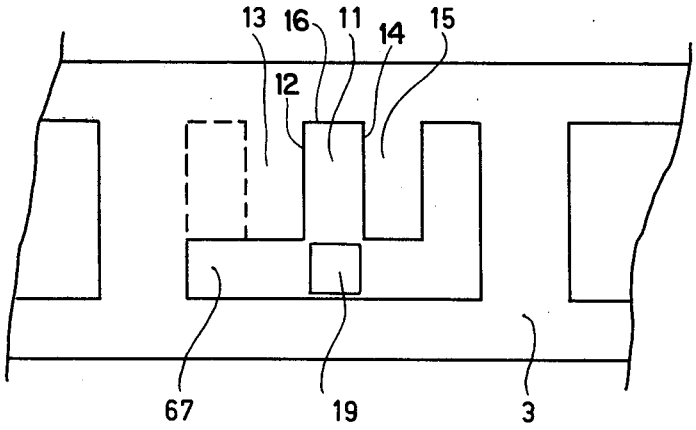
FIG. 5 shows a variant of the switching bar shown in FIG. 1.

The variant of a switching bar 3 which is shown in FIG. 5 is characterized by the fact that it is closed, but one of the recesses situated on both sides of the teeth 13 and 17 is dispensed with (denoted by broken lines). The profile of the recess is now F-like instead of the E-like profile of the switching bar shown in FIG. 1.

It is to be noted that the open portion of the switching bar 3 which is denoted by the reference numerals 65 and 67 in the FIGS. 1 and 5, respectively, must have a length which is at least equal to the stroke of the switching bar. It will be obvious that this is necessary because of the further catching members associated with the switching bar.

Because in a crosspoint switch according to the invention the selection bars as well as the switching bars which have been used for switching on a crosspoint can be used for switching on or switching off further crosspoints whilst the first crosspoint remains switched on, a crosspoint field composed of these switches can be considered as an assembly of sub-fields which are to be operated independent of each other. With respect to known crosspoint switches this offers the advantage that, the requirements as regards occupation and stagnation of the crosspoint field remaining the same, a smaller number of crosspoints suffices.

Using the described elements of the switch, it is moreover possible to provide so-called separating contacts by means of an additional bar and an additional single contact strip. It will be obvious that in that case the relevant contacts must be constructed as break contacts.

What is claimed is:

1. A crosspoint switch comprising a number of selection bars having a plurality of engaging surfaces and a corresponding plurality of disengaging surfaces, means for mounting said selection bars and for selectively moving said bars between a neutral position and a selection position, a number of switching bars having a plurality of actuating surfaces and a corresponding plurality of releasing surfaces, means for mounting said switching bars so as to cross said selection bars, and for selective movement of said switching bars between a neutral position and a switching position, crossings of a selection bar and a switching bar defining a plurality of crosspoints, each crosspoint having associated therewith a corresponding engaging surface, disengaging surface, actuating surface and releasing surface, movement of a corresponding actuating and releasing surface of a switching bar defining a switching path;

a plurality of catching members corresponding to said plurality of crosspoints, each catching member comprising a projection;

means for mounting respective ones of said catching members for movement along first and second directions, so disposed that each projection extends between a respective engaging and a respective disengaging surface of the selection bar defining the corresponding crosspoint for movement along said first direction in response to movement of said selection bar between the neutral and selection positions; said selection bar being in the selection position, each projection associated therewith being disposed to extend across the corresponding switching path of said switching bar surfaces, such that movement of the switching bar moves said projection along the second direction; said selection bar being in the neutral position, each projection associated therewith being disposed to one side of said path;

a plurality of coupling members corresponding to said projections;

means for mounting respective ones of said coupling members, and for coupling corresponding coupling members to corresponding projections for movement between a neutral and a switched position in response to movement of said projection in said second direction only;

a plurality of switches associated with respective crosspoints; and means for actuating a respective switch in response to the position of the respective coupling member, said surfaces, projections, and coupling members being so arranged that:

1. a coupling member and a corresponding switching bar being in the neutral position and the corresponding selection bar being in the selection position, the corresponding projection is adjacent an actuating surface such that movement of the switching bar to the switching position will move the projection along the second coordinate direction thereby moving the coupling member to the switched position, thus actuating the corresponding switch;
2. a coupling member and a corresponding switching bar being in the switched and switching position respectively, the corresponding selection bar being in the selection position, the corresponding projection is adjacent a releasing surface such that movement of the switching bar to the neutral position will move the projection thereby moving the coupling member to the neutral position; and
3. upon movement of a selection bar to the neutral position, each projection associated with that bar is moved out of the path of the surfaces of the respective switching bar so that the corresponding coupling members remain in their previous positions independent of movement of the switching bars.

2. A crosspoint switch as claimed in claim 1 wherein said coupling members are slidingly mounted in said means for mounting the coupling members, and each catching member is mounted slidingly on the corresponding coupling member for motion orthogonal to the sliding movement of the coupling member.

3. A crosspoint switch as claimed in claim 2 wherein, corresponding to each coupling member, said means for actuating a respective switch comprises a pushing member and an actuation member arranged to produce a biasing force, the pushing member having a stable neutral position, and a stable actuated position opposed by said biasing force.

4. A crosspoint switch as claimed in claim 3 wherein each pushing member has two ends, one end pivotally coupled to the corresponding coupling member about an axis perpendicular to said second coordinate direction, the other end pivotally coupled to the corresponding actuation member about an axis parallel to said axis, at least one of said pivotally coupled ends coupling with friction.

5. A crosspoint switch as claimed in claim 3 wherein the pushing member comprises a roller journalled to be rotatable in the acutation member, the coupling member comprising a cam surface having two substantially flat surface portions and an intermediate portion connecting the substantially flat portions, on which cam surface the roller bears.

6. A crosspoint switch as claimed in claim 5 wherein at least a portion of the actuation member is displaceable in a direction perpendicular to a plane parallel to the selection bars and switching bars as a result of movement of the coupling member such that the roller bears first on one and then on the other substantially flat cam surface portion.

7. A crosspoint switch as claimed in claim 6, comprising a plurality of sets of contact reeds, eadch set being associated with a crosspoint, a set comprising at least two flexible contact reeds which cross each other near said crosspoint, two contact reeds of a set being formed by flexible tags cut from metal strips which cross each other at right angles, each strip being rigidly secured in the crosspoint switch on both sides of a contact thus formed.

8. A crosspoint switch comprising a plurality of elongated selection bars having parallel longitudinal axes and a plurality of elongated switching bars having parallel longitudinal exes disposed at right angles to the selection bars so as to cross each other, each crossing defining a crosspoint, each bar having a recess in the vicinity of each crosspoint;

means for mounting the selection and switching bars for motion along their axes, each switching bar movable along a given length of stroke;

a plurality of catching members, one corresponding to each crosspoint, and means for mounting said catching members to be movable parallel to each of said axes;

a plurality of electrical contacts, at least one being associated with each crosspoint; and means for actuating said conacts, comprising a plurality of coupling members each associated with a corresponding crosspoint and having two stable positions, wherein each selection bar comprises an elongated recess therethrough extending transverse to the direction of movement of the selection bar, said recess having a length greater than the stroke of the corresponding switching bar, each switching bar comprises a recess corresponding to each crosspoint, said recess having a first portion formed at least by first and second walls extending parallel to the direction of movement of the selection bars and forming a guide for a portion of the catching member, said second wall being formed on one side of a tooth having a wall defining a second recess portion, said bars and catching members being so arranged that a portion of each catching member projects into the recess of a corresponding selection bar, and upon movement of said selection bar to a selection position projects into a portion of the corresponding recess of the switching bar, the corresponding catching member being in a neutral position in which the corresponding electrical contacts are not actuated, and said switching bar being in a neutral position, said portion of said catching member is aligned with said first portion of said recess, and a selection bar and a switching bar being in the selection and switching positions respectively, the corresponding catching member being in a position in which the corresponding electrical contact is actuated, said portion of said catching member extends into said first portion of said recess.

9. A crosspoint switch as claimed in claim 8, wherein said second recess portion of each switching bar is arranged such that, a selection bar and switching bar being in the neutral positions respectively, the corresponding catching member being in a position in which the corresponding electrical contact is actuated, said portion of said catching member is aligned with said second recess portion and excitation of the corresponding selection bar will move said catching member portion into said second recess portion.

10. A crosspoint switch as claimed in claim 9, wherein each catching member is slidably mounted in a corresponding coupling member for motion parallel to the selection bar axes, and said a actuating means comprises means for slidably mounting each coupling member for motion parallel to the switching bar axes, and at least one pushing means corresponding to each coupling member for moving a corresponding switch actuating member, said pushing means so coupled mechanically between said coupling member and switch actuating member as to have two stable positions corresponding to different positions of the coupling member.

11. In a crosspoint switch including a base having thereon fixed contacts and movable contacts extending from said base in engageable relationship with said fixed contacts; and a coupling member slidably supported by said base above said movable contacts, said coupling member including a surface for pressing said movable contacts into engagement with said fixed contacts upon movement of said coupling member from a first to a second position, an improved coupling member translating arrangement comprising:

a catching member movably connected to said coupling member, said catching member including a projection, said catching member being so arranged that said projection is movable with respect to said coupling member along a coordinate direction orthogonal to a direction of movement of said coupling member between said first and second positions;

a switching bar having a recess therein for selectively engaging said projection and moving said coupling member; and a selection bar having engaging and disengaging surfaces, one of said engaging surfaces being selectively engageable with said projection for moving said projection into said recess of the associated switching bar, and one of said disengaging surfaces serving to move said projection out of engagement with said recess, said selection and switching bars cooperating with said projection on said catching member to selectively move said coupling member from said first to said second position and from said second to said first position.

12. The improved coupling member translating arrangement as claimed in claim 11 wherein said base includes a projecting element for supporting said switching bar in operative relationship with said projection.

* * * * *